US005233262A

United States Patent [19]

Lynn et al.

[11] Patent Number: 5,233,262

[45] Date of Patent: Aug. 3, 1993

[54] FLAT FORM GAS DISCHARGE LAMP WITH OPTICAL REFLECTING MEANS

[75] Inventors: Judd B. Lynn, P.O. Box 49174, Colorado Springs, Colo. 80949; William E. Coleman, Colorado Springs, Colo.

[73] Assignee: Judd B. Lynn, Colorado Springs, Colo.

[21] Appl. No.: 884,519

[22] Filed: May 15, 1992

[51] Int. Cl.[5] ..... H01J 5/16; H01J 61/35; H01J 61/42

[52] U.S. Cl. ..... 313/113; 313/111; 313/114; 313/493

[58] Field of Search ..... 313/113, 493, 114, 111

[56] References Cited

U.S. PATENT DOCUMENTS 2,102,049 12/1937 Warren ..... 313/114 X
3,226,590 12/1965 Christy ..... 313/109
3,646,383 2/1972 Jones ..... 313/109

FOREIGN PATENT DOCUMENTS 77077 4/1983 European Pat. Off. .
1-175160 7/1989 Japan .

*Primary Examiner*—Palmer C. Demeo
*Attorney, Agent, or Firm*—Flehr, Hohbach, Test, Albritton & Herbert

[57] ABSTRACT

A flat form gas discharge lamp is disclosed which includes glass front and back plates mounted together and in which the front plate is formed with a plurality of channels which are sealed to confine an ionizable medium. The channels are oriented in parallel relationship and are separated by gaps. Optical means is placed in the gaps for intercepting secondary light which is transmitted laterally from side walls of the channels and redirected toward the front of the lamp. Secondary light in combination with the primary transmitted through front walls of the channels provides illumination across an area with optimum brightness uniformity and efficiency.

32 Claims, 5 Drawing Sheets

FLAT FORM GAS DISCHARGE LAMP WITH OPTICAL REFLECTING MEANS

BACKGROUND OF THE INVENTION

1. Field of the Invention

This invention relates in general to flat form gas discharge channel lamps for providing fluorescent or neon light. The various embodiments of the invention have a wide range of application where flat form lamps are desirable such as in computer displays, space lighting, illuminated alpha numeric displays and the like.

2. Description of the Prior Art

In the prior art, gas discharge lamps have been provided for enclosing an ionizable medium in a vacuum-sealed glass envelope which has a thin and flat configuration. In order to withstand the force of atmospheric pressure while keeping the glass thickness relatively thin, one or both sides of the envelope are formed with channels separated by ribs in the manner disclosed in International Application PCT/US91/004997 Thin Configuration Flat Form Vacuum-Sealed Envelope with international filing date of Jul. 19, 1991 by Lynn et al. and which is assigned to the assignee of the present invention.

Among the prior art literature is U.S. Pat. No. 3,646,383 to Jones which provides a fluorescent panel lamp having a series of channels of U-shaped cross-section for containing the ionizable medium. Also, U.S. Pat. No. 3,226,590 to Christy provides another type of fluorescent panel lamp with channels having semicircular cross-sections for containing the ionizable medium. Prior art flat form channel lamps inherently have brightness uniformity problems. That is, the lamp area is not uniformly illuminated because the unraised portions of the front plate forming the channels partially blocks off illumination from the lamp. The prior art attempts to reduce the brightness uniformity problem is exemplified by the Jones patent which provides a specified depth-to-width ratio of the groove between the channels, and control of a nearly vertical groove wall angle, to partially increase the light in the area between the channels. Similarly, the Christy patent controls the wall angle of the channel sides for partially increasing the light in the inter-channel area.

European patent no. 77,077 of Schipp is an example of a lamp having a flat plate on the light output side. The flat plate covers a back side which has a formed shape with mirrored surfaces to create complex reflecting angles. A similar concept is embodied in conventional tubular fluorescent lamps which use reflectors behind and between the lamps to redirect the light forward. However, these designs require adequate space behind the lamps for placement of the reflectors, and are impractical where thin configuration lamps are required, such as for backlighting of LCD screen displays for computers.

OBJECTS AND SUMMARY OF THE INVENTION

It is a general object of the present invention to provide a flat form gas discharge channel lamp and method of operation which obviates many of the disadvantages and drawbacks of prior art lamps of this type.

Another object is to provide a flat form channel lamp of the type described which provides highly uniform illumination across a display area.

Another object is to provide a flat form channel lamp of the type described producing high illumination efficiency.

Another object is to provide a flat form channel lamp of the type described which is capable of operating at less power in relation to conventional channel lamps that produce equivalent luminance output.

The invention in summary provides a thin configuration flat form lamp having channels formed between front and back plates of an envelope for confining an ionizable medium for producing fluorescent or neon light. The channels are laterally spaced apart by gaps which contain means for redirecting the light toward the front of the lamp. Light produced in the channels is transmitted forwardly through the front walls and laterally through the side walls. In certain embodiments the light transmitted through the side walls is intercepted by reflectors in the gaps which redirect the light toward the front. This permits the display to be viewed without substantial loss of brightness uniformity. In other embodiments the light transmitted through the side walls is intercepted by refractors which redirect the light forwardly. In one embodiment the reflector is formed of a material which conducts heat between different portions of the lamp for maintaining temperature uniformity.

The foregoing and additional objects and features of the invention will appear from the following specification in which the several embodiments have been described in connection with the accompanying drawings.

DETAILED DESCRIPTION OF THE INVENTION

Figure 1:
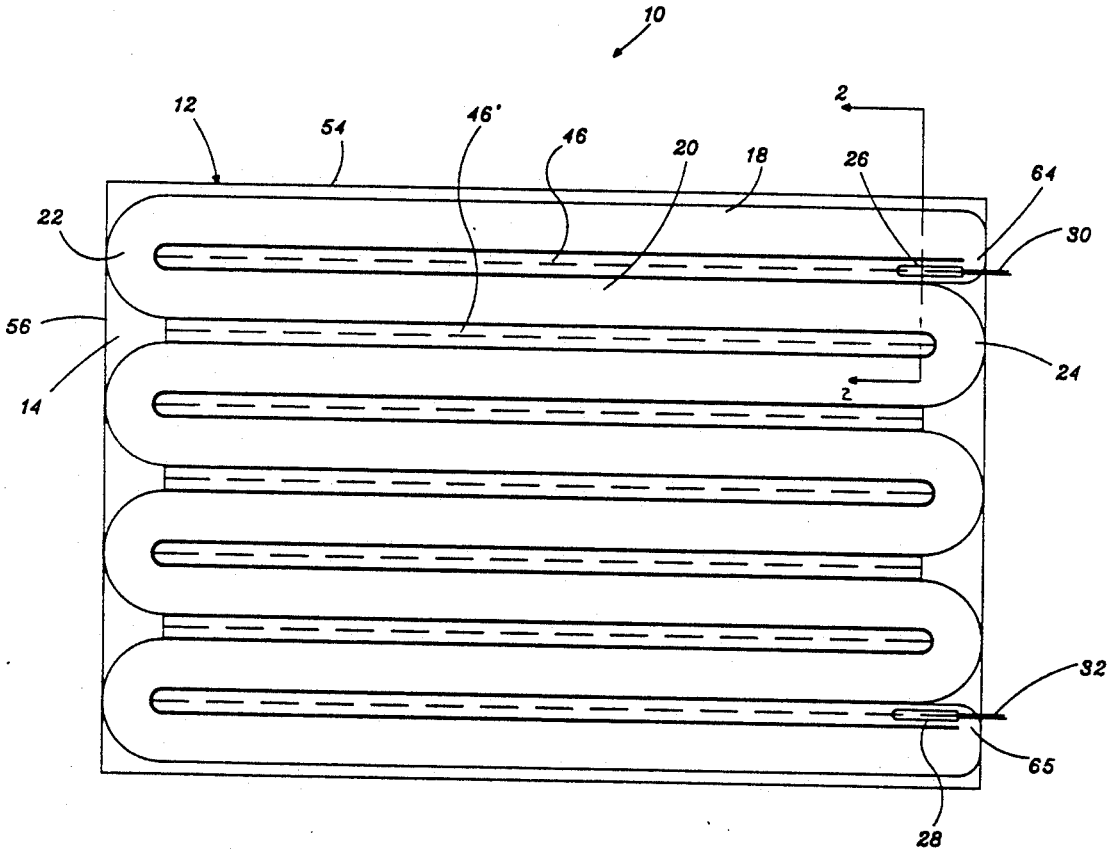
FIG. 1 is a plan view of a flat form lamp incorporating one embodiment of the invention.
Figure 2:
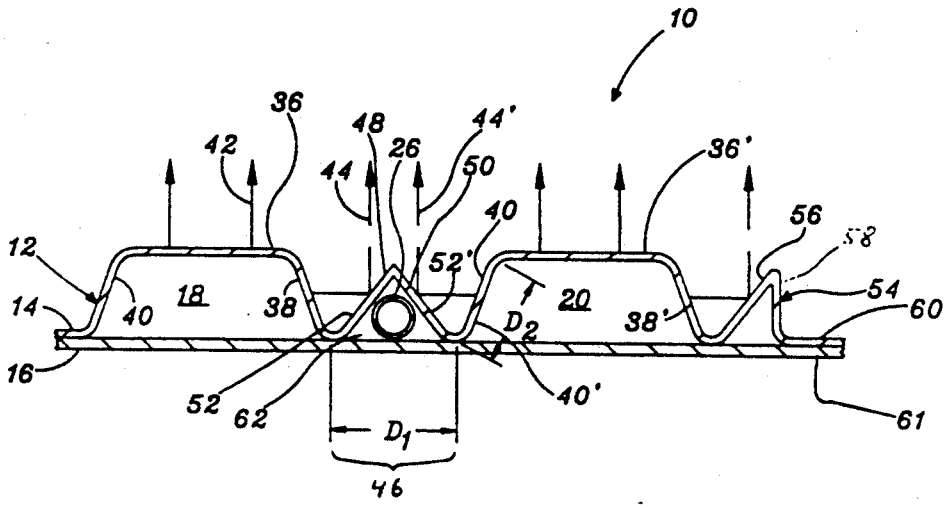
FIG. 2 is a cross-section of the lamp taken along the line 2—2 of FIG. 1.

FIGS. 1 and 2 illustrate one preferred embodiment of the invention providing a flat form gas discharge lamp 10. Lamp 10 includes an envelope 12 which is comprised of a front plate 14 and back plate 16 mounted in substantially parallel face-to-face relationship. Preferably the two plates are formed of a transparent vitreous material such as clear optical quality glass. The front plate is molded to form a plurality of channels 18, 20 oriented in side-by-side relationship. As illustrated in FIG. 1, the channels are interconnected by U-shaped elbow portions 22, 24 to form a continuous circuitous path which substantially covers the illumination display area, shown as a rectangle in this embodiment. FIG. 1 illustrates a lamp with eight interconnected channels across the display area, although the number of channels, as well as their length and width, would depend on the requirements of a particular application. Also, a series of channels with independently sealed volumes and pairs of electrodes could be formed in side-by-side parallel relationship, as desired.

A pair of discharge electrodes 26, 28 connected through conductors 30, 32 with a suitable AC drive control circuit, not shown, are provided in or adjacent to the ends of the channels which are at opposite ends of the circuitous path. The channels form a continuous cavity along the path for hermetically containing an ionizable medium. In the illustrated embodiment in which lamp 10 produces fluorescent light, an ionizable medium comprising gas which produces ultra violet light responsive to an electrical discharge is contained under a partial vacuum within the channel cavity. An ionizable medium comprising a mixture of inert gases such as Argon and a small percentage of Mercury gas is suitable for this purpose. Gas pressure in the cavities is preferably within the range of three to thirty torr. The inner surfaces of the portions of the plates which define the channels are coated with a suitable activated powder phosphor, such as magnesium tungstate or calcium fluorochlorophosphate:antimony:manganese. As is well known, the gas is excited by electrons discharged from the electrodes and produces ultra violet light. The phosphor coating absorbs the ultra violet radiation and reradiates at wave lengths visible to the human eye.

The flat form channel lamps of the invention can also operate to provide neon illumination. In such a case the inner surfaces of the channels would not be coated with phosphors, and the channels would be charged with neon gas. The neon gas would produce direct light responsive to an electric discharge from the electrodes.

As best illustrated in FIG. 2, the lamp's front plate 14 is formed so that each channel has a transparent front wall 36, 36' spaced above the back plate, and a pair of transparent side walls 38, 38' and 40, 40' which extend rearwardly to the back plate. Primary light produced in the channels is transmitted through the front walls in a forward direction, as generally shown by the arrows 42, for viewing from a position in front of the lamp. Secondary light from the channels is transmitted through both side walls in lateral directions, as generally shown by the arrows 44, 44', and into gaps 46 which separate each adjacent pair of channels. The pattern of light transmitted through the front and side walls is in accordance with the Lambert-Bouguer law, and the arrows generally show the directions of peak illumination for the light rays.

The secondary light transmitted into each gap from the adjacent channels is intercepted and redirected forward by optical means which comprises a pair of reflector walls 48, 50. In this embodiment the reflector walls are molded integral with front plate 14. The two walls 48, 50 form a reflector body having a V-shaped cross section. The walls are flat and oriented at a predetermined angle to the lateral direction. The reflector wall angle is a function of the angle of the channel side walls. For practical purposes the channel side walls incline outwardly and downwardly from perpendicular to the back plate. The reflector walls are correspondingly oriented so that the included angle which they make with the lateral direction of the secondary light is in the range of substantially 55° to 60°.

Opaque mirror coatings 52, 52' are formed over the flat surfaces of the walls for reflecting the secondary light forward. The mirror coatings can be applied to the front surfaces of the reflector walls, such as by sputter plating with aluminum. Alternatively, the mirror coatings can be applied to the back surfaces of the walls so that the light is transmitted through the walls and internally reflected from the coatings. The invention contemplates that other means could be employed to form the reflective surfaces, such as by highly polishing metal reflector surfaces or by applying coats of reflective paint.

Along the four edges around the periphery of the lamp, edge reflectors 54, 56 are provided for intercepting and redirecting forward secondary light which is transmitted from the portions of the channels which are adjacent the periphery. FIG. 2 shows the typical edge reflector 54 which is integral with front plate 14 and forms a continuation of side wall 38' of channel 20. A single reflector wall 56 inclines at an included angle with the lateral direction in the range of substantially 55° to 60°. An integral rim portion 58 at the periphery of the front plate extends down to the back plate. A suitable reflective medium, such as an opaque mirror surface, is provided on edge reflector wall 56 for intercepting the peripheral secondary light and redirecting it forward. An hermetical edge seal is formed between the rim 60 of the top plate and the rim 61 of the back plate by suitable means such as a glass frit, not shown. Preferably back plate 16 is formed of the same type of glass used for the front plate so that the coefficients of thermal expansion of the two components are equal. A suitable diffuser plate, not shown, can be mounted across front plate 14 as required by the particular application. Such a diffuser plate can be employed to increase uniformity of the light display. Typically a diffuser plate would not be desired in applications requiring maximum light output, such as space lighting applications, because the plate would reduce light output efficiency.

The invention provides a preferred relationship between the dimensions of the channel side walls and the gap width to achieve high illumination efficiency. With the reflector side walls shaped so that they intercept and redirect the secondary light which is transmitted in lateral directions from the two channels, then for 100% theoretical efficiency, the combined base width of the two reflector walls should be twice the dimension of each side wall. In practical applications there is some light loss so that the invention provides that the preferred dimensional relationship is in accordance with the formula:

$$D_1 = 1.25 \text{ to } 1.75 \times D_2$$

where $D_1$ = the width of reflector base, and $D_2$ = the width of each reflector side wall.

Hollow cavities 62 of triangular cross section are formed along each gap between reflector walls 48, 50 and back plate 16. These cavities provide space for placement of the discharge electrodes 26 and 28 in the gaps adjacent the outermost channels. The cavities 62 provide mounting space for the electrodes to enhance the frontal form factor of the lamp by reducing the unlighted area that would otherwise be lost where the electrodes would be incorporated as an extension of the lighted area. This electrode placement also does not increase the lamp thickness, which would be the result with rear projecting electrode designs. Passageways 64 and 65 (FIG. 1) are molded in the front plate to provide gas communication between the outermost channels and cavities. The ionizable medium from the channels fills the cavities through the passageways so that electrical discharge from the electrodes excites the gas along the channels.

In the method of operation of lamp 10, fluorescent light is generated within the channels when electrodes 26 and 28 are energized by the control circuit. The primary portion of the light is transmitted through the channel front walls 36 toward the front of the lamp. Secondary portions of the light are transmitted laterally through side walls 38 and 40 into the gaps 46 where the light is intercepted by reflector walls 48, 50 and redirected toward the front. The side wall dimension is preferably proportional to the gap width in accordance with the relationship $D_1 = 1.25$ to $1.75 \times D_2$. The dimensional relationship selected for a particular lamp application depends on the degree of light uniformity desired for the lamp display.

A specific example for the lamp of FIGS. 1–2 is for an application in which the lamp thickness is 4.5 mm providing a lighted area of 10.1 cm×15.2 cm or 154 $cm^2$. The front plate is glass with a thickness of 0.7 mm. The front plate is molded to form eight channels serially interconnected as shown in FIG. 1. Each channel has a width of 9.5 mm and a length of 15.2 cm. The width of each gap between the channels is 3.1 mm. The total channel frontal area is 115 $cm^2$, and the total frontal area of the gaps is 33 $cm^2$. To light this 10.1 cm×15.2 cm combined area to a luminance of 1,000 footlamberts requires approximately 3.35 watts power. A conventional flat form channel lamp having closely spaced channels requires approximately 5 watts to produce a luminance of 1,000 footlamberts across a surface of 10.1 cm×15.2 cm. With the present invention this reduction of 33% in the power requirements for producing comparable luminance is critical in applications where low power and/or low heat are important factors, such as portable computers or TV receiver displays.

Figure 3:
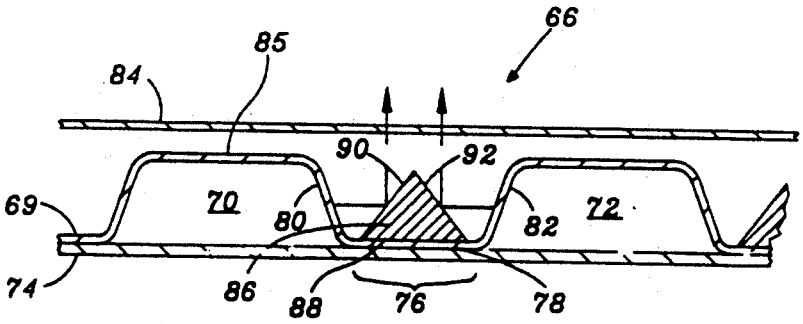
FIG. 3 is a fragmentary cross-sectional view of a flat form lamp according to another embodiment of the invention.

FIG. 3 illustrates another embodiment providing a flat form gas discharge lamp 66 having a front plate 68 formed with a plurality of channels 70, 72 and mounted against a back plate 74. Preferably the front and back plates are of a transparent vitreous material such as clear glass. The channels can be interconnected to form a continuous cavity for enclosing the ionizable medium, and suitable electrodes, not shown, are mounted within the channels in the manner described for the embodiment of FIGS. 1 and 2. The channels are in parallel-spaced-apart relationship separated by gaps 76. Flat portions 78 of the front plate are integral with the channel side walls 80 and 82 and extend across the gaps in contact with the back plate. As required by the particular application, flat portions 78 can be sealed to the back plate. A diffuser plate 84, which can be a suitable acrylic plastic, is mounted across the front walls 85 of the channels.

Optical means is provided for intercepting secondary light transmitted through side walls 80, 82 and redirecting the intercepted light toward the front of the lamp. The optical means comprises an elongate reflector body 86. In this embodiment the reflector body has a triangular cross section with its base 88 secured as by an adhesive onto the outer surface of flat portion 78 along the length of the gap. The two side walls 90, 92 of the reflector body are flat and lie across the lateral direction of the secondary light beam transmitted into the gap from the channel. Preferably the side walls are oriented at included angles with the lateral direction in the range of substantially 55° to 60°. An edge reflector, not shown, at the perimeter of the lamp is advantageously formed by a similar triangular-shaped reflector body.

In this embodiment the reflector body is fabricated of a good heat conducting material, e.g. a metal such as aluminum. The reflector body is machined, die cast or otherwise formed into the triangular configuration. Reflective surfaces on the side walls 90, 92 are formed by suitable means such as highly polishing the surfaces or by applying a coating of reflective paint. The reflector body is in heat transfer relationship with portions of the envelope, particularly along the reflector's base which is in face-to-face contact with the flat portions of the front plate. The reflector body transfers heat between portions of the envelope which are at differential temperatures for enhancing uniform temperatures throughout the lamp, particularly for maintaining uniform wall temperatures. This embodiment has particular application where wide ambient temperatures may be encountered, such as aircraft application, or where the lamp may be operated from very low brightness to very high brightness levels.

Figure 4:
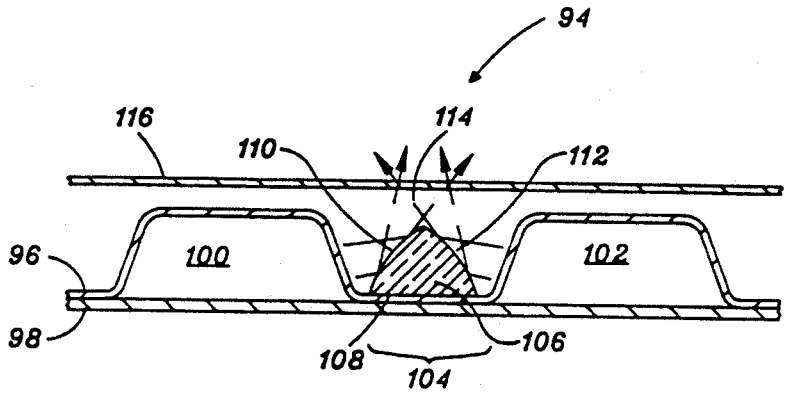
FIG. 4 is a fragmentary cross-sectional view of a flat form lamp according to a further embodiment of the invention.

FIG. 4 illustrates another embodiment providing a flat form gas discharge lamp 94. Lamp 94 is comprised of front and back glass plates 96, 98 with the front plate molded into parallel channels 100, 102 separated by gaps 104 in the manner described for the embodiment of FIG. 3. Optical means for intercepting secondary light transmitted from the side walls of the channels is provided and comprises an elongate reflector body 106 mounted along the length of each gap. The reflector body has a base 108 secured by a suitable adhesive along the gap, together with a pair of reflective side surfaces 110, 112 which are formed into predetermined optical shapes, such as parabolic. The two sides surfaces are coated with a suitable reflective medium similar to that described for the embodiment of FIGS. 1–2. Secondary light transmitted laterally from the channels intercepts the reflector side surfaces which redirect the light in scattered directions as shown by the arrows 114 in FIG. 4. This light is predominantly redirected toward the front of the lamp. A diffuser plate 116 can be mounted over the front plate, as required by the particular application. The reflector body can be formed of a suitable plastic to save weight, or of a heat conducting material as in the embodiment of FIG. 3 where temperature uniformity is desirable.

Figure 5:
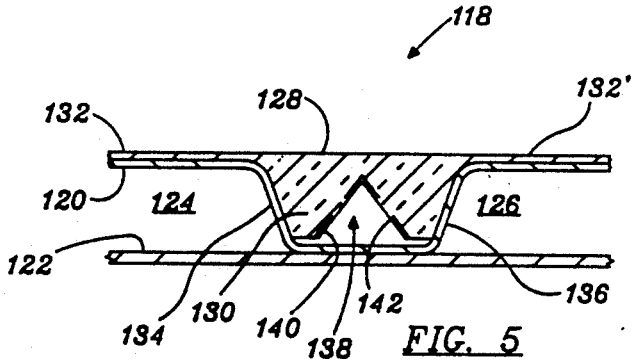
FIG. 5 is a fragmentary cross-sectional view of a flat form lamp according to a further embodiment of the invention.

FIG. 5 illustrates a flat form gas discharge lamp 118 according to another embodiment. The lamp is comprised of front and back glass plates 120, 122 with the front plate molded into the parallel spaced-apart channels 124, 126 similar to the embodiment of FIG. 3. An integrated reflector/diffuser plate 128 of a transparent material is mounted onto the front side of front plate 120. Plate 128 is comprised of a series of parallel elongate reflector portions 130 integrally joined together on either side by means of thin walled diffuser portions 132, 132'.

The outer sides of the reflector portions conform with the shape of channel side walls 134, 136 so that the reflector portion snugly fits down into the gap between the adjacent channels and in contact with the channel side walls. A triangular-shaped groove 138 is formed along the inner side of the reflector portion, with the groove parallel to the channels. The side walls of the groove are preferably oriented at included angles to the lateral direction of secondary light in the range of substantially 55° to 60°. A reflective medium is formed along the outer surfaces 140, 142 of the groove side walls, and the reflective medium can be an opaque mirror coating as described for the embodiment of FIGS. 1–2.

Secondary light emitted laterally from the channels is transmitted through the body of reflector portion 128. The light is then internally reflected from the mirror-coated side walls 140, 142 and redirected toward the front of the lamp.

Figure 6:
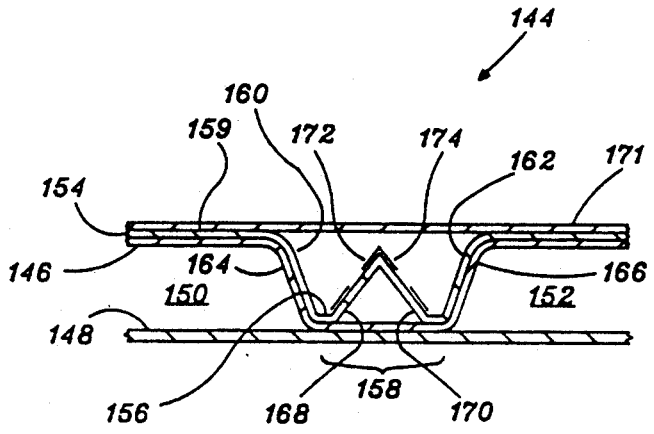
FIG. 6 is a fragmentary cross-sectional view of a flat form lamp according to a further embodiment of the invention.

FIG. 6 illustrates flat form gas discharge lamp 144 according to another embodiment. The envelope of the lamp is comprised of front and back glass plates 146, 148 with the front plate molded to define a plurality of laterally spaced-apart parallel channels 150, 152 in the manner described for the embodiment of FIG. 3. Mounted across the front plate is a plastic film 154 which is molded to form parallel ridges 156. The ridges are sized and positioned to extend inwardly into respective gaps 158 formed between each pair of adjacent channels. The flat portions 159 of the film between the ridges lie in contact with the channel front walls, while the side portions 160, 162 of the ridges lie in contact with respective channel side walls 164, 166. In each ridge the portions of the film between the side walls are formed with upwardly converging walls 168, 170 join together at an apex. The converging walls are oriented at included angles to the lateral direction of secondary light in the range of substantially 55° to 60°. A diffuser plate 171 is mounted over the front of the flat portions of the film.

Film 154 is molded from a suitable clear plastic, and the portions of the film which form the converging side walls carry layers 172, 174 of a suitable opaque reflective medium, such as the reflective paint or metalized coating described for the embodiment of FIGS. 1–2. Secondary light transmitted laterally from the channels is intercepted by the converging side walls of the film and redirected toward the front of the lamp.

Figure 7:
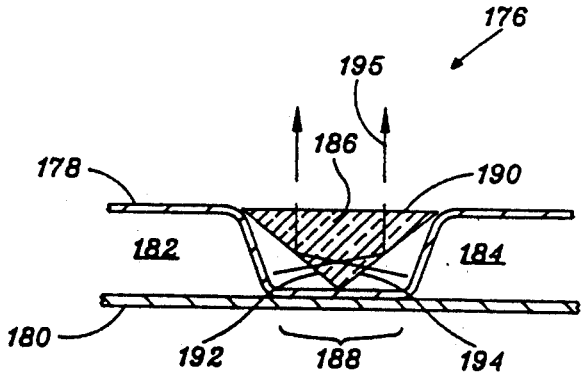
FIG. 7 is a fragmentary cross-sectional view of a flat form lamp according to a further embodiment of the invention.

FIG. 7 illustrates a flat form gas discharge lamp 176 according to another embodiment. The envelope of the lamp is comprised of front and back glass plates 178, 180. The front plate is molded to form a plurality of spaced-apart channels 182, 184 similar to that described for the embodiment of FIG. 4. Elongate reflector bodies 186 are mounted in the gaps 188 between adjacent channels. Each reflector body is formed of a suitable transparent material such as acrylic plastic. The cross section of the reflector body is triangular having a base 190 parallel with the channel front walls and a pair of external side surfaces 192, 194 which converge rearwardly to an apex that rests against the back plate at the middle of the gap. The included angle between external surfaces 192 and 194 is selected so that secondary light from each channel which is transmitted laterally into the closest external surface and through the body is internally reflected forwardly from the opposite external surface, as shown for the path of a typical light ray by the arrow 195 of FIG. 7. This internal reflection occurs when the angle of incidence i which the light ray bears to the normal of the internal surface is greater than the critical angle for the particular material of the body. When this condition occurs there is total reflection of the light ray internally from the surface.

Figure 8:
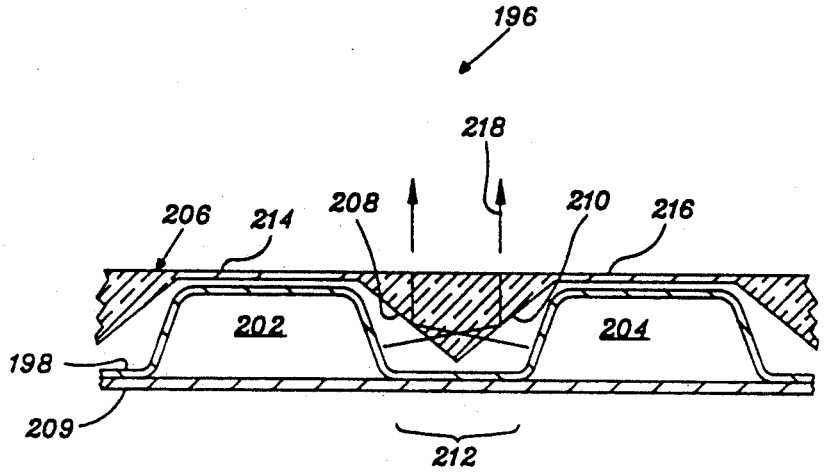
FIG. 8 is a fragmentary cross-sectional view of a flat form lamp according to a further embodiment of the invention.

FIG. 8 illustrates a flat form gas discharge lamp 196 according to another embodiment which also operates by using internal reflectivity. The lamp envelope is comprised of front and rear glass plates 198, 200. The front plate is formed into a plurality of spaced-apart channels 202, 204 in the manner described for the embodiment of FIG. 4. An integral reflector/diffuser plate 206 is mounted over front plate 198. Plate 206 is formed of a suitable transparent material such as acrylic plastic. Portions of plate 206 are formed with downwardly converging external surfaces 208, 210 which extend along each gap 212 between adjacent channels. Integral portions 214, 216 of the reflector/diffuser plate are flat and lie across the channel front walls for diffusing forwardly directed primary light. The included angle between external surfaces 208 and 210 is selected so that secondary light transmitted laterally from the channels is transmitted through the plate material to internally strike the opposing surfaces 208 and 210 at an angle of incidence to normal which is greater than the material's critical angle. This reflects the light rays forward as shown by the typical arrow 218 of FIG. 8.

Figure 9:
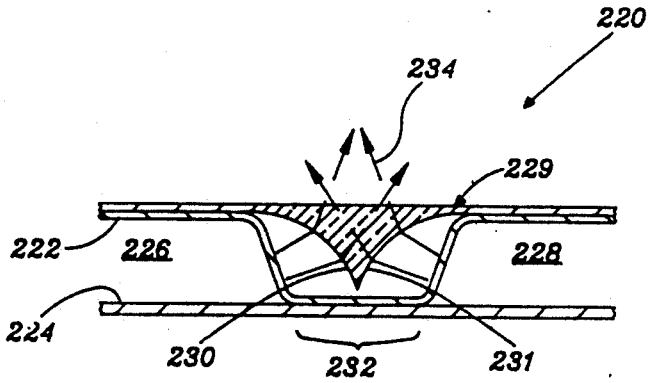
FIG. 9 is a fragmentary cross-sectional view of a flat form lamp according to a further embodiment of the invention.

FIG. 9 illustrates a flat form gas discharge lamp 220 according to another embodiment which operates by using light refraction. The lamp envelope is comprised of front and rear glass plates 222, 224. The front plate is formed with a plurality of spaced-apart channels 226, 228 in the manner described for the embodiment of FIG. 4. An integral refractor/diffuser plate 229 formed of a suitable transparent material such as acrylic plastic is mounted across the front of the lamp. Portions of the lamp are formed with curvilinear refracting surfaces 230, 231 which converge inwardly into the gaps 232 between each pair of adjacent channels. Secondary light emitted laterally from the channels is refracted at the surfaces 230 and 231 toward the front of the lamp in the manner indicated by the arrow 234 of FIG. 9. As is well known, the degree to which the light rays are refracted depends on the index of refraction of the particular material employed for the refractor/diffuser plate. Where n is the index of refraction of the material, i is the angle of incidence and r is the angle of refraction, then the light rays are refracted in accordance with the following formula:

$$\sin r = \frac{\sin i}{n}$$

As used herein and in the appended claims, the phrase "optical means" is intended to mean: 1) a body having a front surface, either planar or curvilinear, which is formed with a reflective surface for reflecting light which is incident on the front surface to change its direction, or 2) a transparent body having a rear surface, either planar or curvilinear, which is formed with a reflective surface for reflecting light which is transmitted from the front and is internally incident on the reflective surface to change its direction, or 3) a transparent body having surfaces which internally reflect light which strikes at an angle of incidence to normal which is greater than the critical angle to change its direction, or 4) a transparent body having surfaces, either planar or curvilinear, for refracting the incident light to change its direction. Also as used herein, the words "redirect" or "redirected" are intended to mean changing the direction of light by reflection, refraction or a combination of reflection and refraction. As used herein the phrase "reflective medium" is intended to include: 1) a reflective surface on an opaque body, or 2) a mirrored surface on the back of a transparent body, or 3) a transparent body which redirects light by internal reflection or refraction, or by combination of internal reflection and refraction. Also as used herein the phrase "ionizable medium" means a gas or combination of gases which produce ultra violet light under influence of an electric charge as well as neon gas which produces direct illumination responsive to an electric charge.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A flat form gas discharge lamp for illuminating a defined area with optimum brightness uniformity and illumination efficiency, the lamp comprising the combination of an envelope comprising front and back plates mounted in substantially parallel face-to-face relationship, means for defining a plurality of channels between the plates for confining an ionizable medium for producing light under influence of an electric discharge, said channels extending along adjacent spaced-apart paths which project across the defined area, said envelope further comprising substantially transparent front walls in the channels which transmit primary light in a forward direction from the channels for viewing from a position in front of the lamp, said envelope further comprising substantially transparent side walls in the channels which transmit secondary light in a lateral direction from the channels, said side walls extending rearwardly from the front walls, at least two of the side walls of adjacent channels being positioned in side-by-side relationship and separated by a gap, and optical means for intercepting the secondary light which is transmitted through the side walls and redirecting the intercepted light along said forward direction whereby brightness uniformity is substantially maintained across the defined area.

2. A flat form gas discharge lamp as in claim 1 in which said optical means redirects the intercepted light across substantially the area of the gap, 3. A flat form gas discharge lamp as in claim 1 in which each side wall extends a distance $D_2$ between the front and back plates, and said optical means extends transversely across the gap a distance $D_1$ which is in the range of substantially 1.25 to 1.75 times $D_2$.

4. A flat form gas discharge lamp as in claim 1 in which said optical means is comprised of an elongate reflector body mounted along the length of the gaps, said reflector body having opaque light reflective surfaces oriented across the lateral direction of the secondary light being transmitted from the channels for reflecting said intercepted light toward the front of the lamp.

5. A flat form gas discharge lamp as in claim 4 in which the reflective surfaces of the body are flat and are oriented at a predetermined angle with respect to the lateral direction of the secondary light being transmitted from the channels.

6. A flat form gas discharge lamp as in claim 5 in which the reflector body has a triangular configuration in cross section.

7. A flat form gas discharge lamp as in claim 4 in which the reflective surfaces of the body are curved with optical shapes which reflect the secondary light in predetermined directions substantially toward the front of the lamp.

8. A flat form gas discharge lamp as in claim 4 in which the reflector body is formed of a heat conducting material and is in thermal contact with portions of the envelope for conducting heat between envelope portions which are at differential temperature levels for enhancing uniform temperature throughout the lamp.

9. A flat form gas discharge lamp as in claim 8 in which the reflector body is formed of metal.

10. A flat form gas discharge lamp as in claim 1 in which the optical means is comprised of selected portions of said front walls disposed in said gaps, said selected portions having a reflective medium oriented across the lateral direction of the secondary light being transmitted from the channels for reflecting said secondary light along said forward direction.

11. A flat form gas discharge lamp as in claim 1 in which the optical means is comprised of a film of transparent material disposed in a layer over the surface of the front plate which faces the forward direction, with selected portions of the film having a reflective medium which is disposed in the gaps and oriented across the lateral direction of secondary light being transmitted from the side walls for reflecting said secondary light toward the front of the lamp.

12. A flat form gas discharge lamp as in claim 1 in which the envelope includes means forming a diffuser plate positioned across the front plate for diffusing said primary light and reflected secondary light, and said optical means is integrally formed with said diffuser plate.

13. A flat form gas discharge lamp as in claim 12 in which the optical means is comprised of selected portions of the diffuser plate having opaque reflecting surfaces disposed in the gaps and oriented across the lateral direction of the secondary light being transmitted from the channels for reflecting said intercepted light toward the front of the lamp.

14. A flat form gas discharge lamp as in claim 1 in which the optical means is comprised of transparent bodies disposed in the gaps, said bodies having a critical angle of optical reflection and are formed with external surfaces, and means for mounting the bodies within the gaps so that the secondary light transmitted from the channels into the bodies internally strikes said external surfaces at an angle of incidence to normal which is greater than said critical angle for internally reflecting said secondary light toward the front of the lamp.

15. A flat form gas discharge lamp as in claim 14 in which the external surfaces are flat.

16. A flat form gas discharge lamp as in claim 14 in which the external surfaces are curved with optical shapes which redirect the reflected light in predetermined directions substantially along the front of the lamp.

17. A flat form gas discharge lamp as in claim 14 in which the envelope includes means forming a diffuser plate positioned across the front plate for diffusing said primary light and reflected secondary light, and said transparent bodies are integrally formed with said diffuser plate.

18. A flat form gas discharge lamp as in claim 1 in which means are disposed around the perimeter of the envelope for intercepting peripheral light which is transmitted toward the perimeter from the side walls of the channels and for redirecting said peripheral light toward the front of the lamp.

19. A flat form gas discharge lamp as in claim 1 in which said optical means comprises a transparent body having side surfaces through which the secondary light from the channel side walls enters at a predetermined angle and is refracted along said forward direction.

20. A flat form gas discharge lamp as in claim 19 in which said side surfaces are planar.

21. A flat form gas discharge lamp as in claim 19 in which said side surfaces are curvilinear.

22. A flat form gas discharge lamp as in claim 1 which includes said ionizable medium comprises neon gas, and including electrode means for generating said electric discharge within the channels for exciting the neon gas to produce the light.

23. A flat form gas discharge lamp as in claim 1 in which said ionizable medium comprises a gas which emits ultra violet light responsive to an electric discharge, including a layer of phosphors which produce fluorescent light responsive to ultra violet light is coated on the inside surfaces of the channels, and including electrode means for generating said electric discharge within the channels for exciting said gas to emit ultra violet light and produce fluorescent light from the layer of phosphors.

24. A flat form gas discharge lamp as in claim 1 in which said optical means comprises a pair of reflector walls in each gap, and means for positioning the reflector walls to diverge apart from a common apex at a predetermined angular relationship and with the reflector walls being disposed across the lateral direction of the secondary light being transmitted from the channels for reflecting said secondary light toward the front of the lamp.

25. A flat form gas discharge lamp as in claim 24 in which a cavity is defined in the gaps between the diverging reflector walls on the sides thereof opposite the reflective surfaces, and including control means for generating said electric discharge within the channels for producing the gas discharge light, with at least a portion of said control means being positioned within at least one cavity.

26. A flat form gas discharge lamp as in claim 25 in which said control means includes an electrode positioned in said one cavity, and including passageway means for communicating said ionizable medium between at least one channel and said one cavity whereby activation of the electrode for producing said electric discharge excites the ionizable medium in the channels to produce the light.

27. A method of operating a flat form gas discharge lamp for illuminating a defined area with optimum brightness uniformity and illumination efficiency, said lamp including an envelope comprised of a plurality of channels each of which has a substantially transparent front wall and substantially transparent side walls and with at least two adjacent channels being separated by a gap, the method comprising the steps of generating gas discharge light within the channels, transmitting a primary portion of the generated light along a forward direction through the front wall of the channels toward the front of the lamp, transmitting secondary portions of the generated light along lateral directions through the side walls of the channels and into said gaps, and redirecting the secondary portions of the light in the gaps toward the front of the lamp whereby light from the envelope can be viewed with insubstantial loss of brightness uniformity across the defined area.

28. A method of operating a flat form gas discharge lamp as in claim 27 in which each gap has a given plane area through which light is transmitted toward the front of the lamp, each channel side wall has a given plane area through which light is transmitted along said lateral directions, and the secondary light is redirected toward the front of the lamp with said combined planar area of the side walls for adjacent channels being at least equal to said planar area of the gap.

29. A method of operating a flat form gas discharge lamp as in claim 27 in which the steps of redirecting the secondary portions of the light includes disposing bodies having opaque reflective surfaces across the lateral directions of the secondary portions of light, and reflecting the secondary portions of light from said reflective surfaces toward the front of the lamp.

30. A method of operating a flat form gas discharge lamp as in claim 29 including the step of conducting heat along said bodies between portions of the lamp which are at differential temperatures.

31. A method of operating a flat form gas discharge lamp as in claim 27 in which the step of redirecting the secondary portions of the light includes positioning within the gaps transparent bodies which have a certain critical angle of optical reflection and an internal reflective surface, passing said secondary portions of light through the bodies to internally strike the internal reflective surfaces at an angle of incidence with respect to the normal which is greater than said critical angle, and reflecting the secondary portions of light internally from said internal reflective surfaces toward the front of the lamp.

32. A method of operating a flat form gas discharge lamp as in claim 27 in which the step of redirecting the secondary portions of the light includes positioning within the gaps transparent bodies which have external surfaces, and passing said secondary portions of light through the external surfaces of the bodies and refracting such light at the external surfaces toward the front of the lamp.

* * * * *